US005881539A

United States Patent [19]

Fukuda et al.

[11] Patent Number: 5,881,539

[45] Date of Patent: Mar. 16, 1999

[54] TRANSVERSE SEALER FOR A PACKAGING MACHINE

[75] Inventors: Masao Fukuda; Yukio Kakita, both of Shiga, Japan; James Lewis, Kohler, Wis.

[73] Assignee: Ishida Co., Ltd., Kyoto, Japan

[21] Appl. No.: 856,105

[22] Filed: May 13, 1997

Related U.S. Application Data

[63] Continuation-in-part of Ser. No. 657,958, Jun. 4, 1996, abandoned.

[51] Int. Cl.[6] ..... B65B 61/24

[52] U.S. Cl. ..... 53/526; 53/551; 53/374.5

[58] Field of Search ..... 53/526, 374.5, 53/374.6, 550, 551, 450, 451, 552, 553, 554, 555, 389.2

[56] References Cited

U.S. PATENT DOCUMENTS

| | | | |
|---|---|---|---|
| 2,915,866 | 12/1959 | Bartlo . | |
| 3,027,695 | 4/1962 | Leasure . | |
| 3,528,214 | 9/1970 | Calvano . | |
| 4,199,919 | 4/1980 | Moscatelli | 53/374.6 |
| 4,291,520 | 9/1981 | Prince et al. | 53/374.6 |
| 4,348,851 | 9/1982 | Prakken . | |
| 4,563,862 | 1/1986 | McElvy . | |
| 4,663,917 | 5/1987 | Taylor et al. . | |
| 4,757,668 | 7/1988 | Klinkel et al. | 53/374.6 |
| 4,947,618 | 8/1990 | Schneider et al. | 53/374.6 |
| 5,014,492 | 5/1991 | Fiorini et al. . | |
| 5,279,098 | 1/1994 | Fukuda . | |
| 5,347,795 | 9/1994 | Fukuda . | |
| 5,388,387 | 2/1995 | McElvy . | |

FOREIGN PATENT DOCUMENTS

| | | | |
|---|---|---|---|
| 0308861 | 3/1989 | European Pat. Off. . | |
| 0368095 | 5/1990 | European Pat. Off. . | |
| 3837709 | 10/1990 | Germany | 53/374.5 |
| 405065144 | 3/1993 | Japan | 53/374.6 |

*Primary Examiner*—James F. Coan
*Assistant Examiner*—Eugene L. Kim
*Attorney, Agent, or Firm*—Majestic, Parsons, Siebert & Hsue P.C.

[57] ABSTRACT

An elongated web of bag-making material (S) is bent into a tubular form by a former (2), transported along a path (A), is filled with articles (W) and sealed by a transverse sealer (10) transversely to its direction of motion. A pair of seal jaws (20) supported by rotary arms (12) are rotated in mutually opposite directions by a power-communicating mechanism (P) which includes a trajectory-forming mechanism (H) such that the seal jaws (20) will each travel on a generally D-shaped trajectory with a linear section along the path (A) of the bag-making material (S). Cramming devices (50) are adjustably attached to the rotary arms (12) and stroke the tubularly shaped bag-making material (S) from both sides in forward-backward direction (X) without substantially closing the bag being formed such that the articles (W) can be more efficiently crammed with empty spaces among them effectively reduced. Stripping rods (42) are attached to the seal jaws (20) for stripping down the articles being dropped into the bag immediately before the transverse sealing and after the cramming by the cramming devices (50) so as to prevent them from becoming caught between the seal jaws (20).

20 Claims, 6 Drawing Sheets

1
2
S
4
3
5
S
3
a
A
10
30
34
38a
45
H
39
R
12
21
22
24
13
38
38b
11
31
40
42
20
20
12
35
30
X
22
24
13
50
50
25
34
X
11
12
Y
25
46
26
Q
P
27
29
28

TRANSVERSE SEALER FOR A PACKAGING MACHINE

This is a continuation-in-part of application Ser. No. 08/657,958 filed Jun. 4, 1996, now abandoned.

BACKGROUND OF THE INVENTION

This invention relates to a bag maker-packaging machine of the type adapted to concurrently make bags and fill them with articles such as food items for packaging. In particular, this invention relates to a transverse sealer intended to be used in such a packaging machine for effecting thermal sealing of the bag-making material in the transverse direction.

So-called pillow-type packaging machines are a kind of bag maker-packaging machine capable of concurrently forming bags and filling these bags with articles to be packaged such as food items. An elongated web of bag-making material (herein referred to as "the film") is formed into a tubular shape by means of a device known as the former, and the film's mutually overlapping longitudinal side edges are sealed together first. While the tubularly formed film is pulled downward, it is thermally sealed in the transverse direction at the bottom by means of a transverse sealer comprising, for example, a pair of transverse seal jaws which may be disposed below a so-called filling cylinder used for filling the tubularly formed film with articles to be packaged. Because the formation of bags and the filling of the bags with articles to be packaged can be carried out concurrently and continuously, such bag maker-packaging machines are considered superior machines with high production efficiency.

Japanese Patent Publication Tokkai 63-30725, for example, disclosed a bag maker-packaging machine of a so-called rotary driven type characterized as moving its pair of transverse seal jaws linearly along the direction of motion of the film while their heat-applying surfaces are contacted to the film such that the transverse sealing can be effected over a sufficiently extended period of time.

A transverse sealer of this type does not give rise to any problem, as the seal jaws B are moved towards each other as shown by arrows in FIG. 8A to effect transverse thermal sealing, if the internal volume of the bag S is sufficiently large compared to the bulk of the articles w inside. Depending on the kind or condition of the articles W to be packaged, however, their volume sometimes becomes too large compared to the bag. This can happen, for example, when the water content of potatoes to be packaged is unusually high. In such a situation, as depicted in FIG. 8B, portions of the articles W to be packaged may be caught between the seal jaws B as they are closed, yielding defective products as a result. In order to prevent occurrences of this nature, it has been known to use the seal jaws as stripping means, as shown in FIG. 8C, holding the seal jaws B in a nearly-completely-closed condition (indicated by letter C) and to move them downward while the bag S remains closed so as to clear the area over which the bag S is to be transversely sealed. This operation is commonly known as "stripping."

Such stripping means C are not necessarily effective for the purpose of reducing empty spaces inside the bag because they are intended merely to strip the articles W downward where the transverse sealing is to take place.

SUMMARY OF THE INVENTION

It is therefore an object of this invention to provide an improved transverse sealer for a bag maker-packaging machine, capable of reducing empty spaces among the articles initially dropped into the tubularly formed bag-making material so as to prevent the articles from being caught between the seal jaws.

It is another object of this invention to provide a bag maker-packaging machine incorporating such an improved transverse sealer.

A transverse sealer embodying this invention, with which the above and other objects can be accomplished, may be characterized as comprising a pair of transverse seal jaws for thermally sealing the film transversely with respect to the direction of its motion, a power transmitting means for transmitting power and thereby causing the transverse seal jaws to undergo rotary motions in mutually opposite directions along specified trajectories each including a linear section which parallels the travel path of the film being made into a bag, and cramming devices for stroking and pressing a loaded bag from both sides without substantially closing the bag being made to thereby reduce empty spaces among the articles inside. With a transverse sealer thus structured, the articles dropped into the tubularly formed film can be pushed from opposite directions such that they can "settle" inside the bag being formed. In other words, the bag becomes more effectively filled and the articles can be more dependably prevented from being caught between the seal jaws.

According to a preferred embodiment of the invention, the transverse seal jaws are supported by rotary members. Each of the cramming devices is adjustably supported by one of the rotary members by passing screws or bolts through elongated holes formed through either the rotary member or the cramming device itself. The force applied to the articles inside the bag can thus be controlled. The cramming device may comprise an elastically deformable bar such that the bar becomes elastically deformed as the articles in the bag are pressed thereby. This serves to prevent damages to the articles being pushed from outside or breakage of the film due to application of an excessive force from the cramming device.

According to a further preferred embodiment of the invention, a pair of stripping rods is attached to the transverse seal jaws, protruding farther towards each other than their heat-applying sealing surfaces which are in face-to-face relationship with respect to each other on opposite sides of the film. The pair of stripping rods is caused to sandwich the film therebetween to substantially close the bag before the sealing surfaces of the seal jaws close and press on the film and continue to move along the travel path of the film, thereby stripping the articles downward and preventing them from getting caught between the transverse seal jaws.

A bag maker-packaging machine embodying this invention may be characterized as comprising a web-transporting means for transporting an elongated web of bag-making material ("the film") along a specified path, a former disposed in this film path for bending this film into a tubular form, a longitudinal sealer for longitudinally sealing mutually overlapping side edge parts of the tubularly formed film, a hopper from which articles to be packaged are dropped into the film being made into a bag, and a transverse sealer of the kind described above as embodying this invention.

BRIEF DESCRIPTION OF THE DRAWINGS

The accompanying drawings, which are incorporated in and form a part of this specification, illustrate embodiments of the invention and, together with the description, serve to explain the principles of the invention. In the drawings.

DETAILED DESCRIPTION OF THE INVENTION

Figure 1:
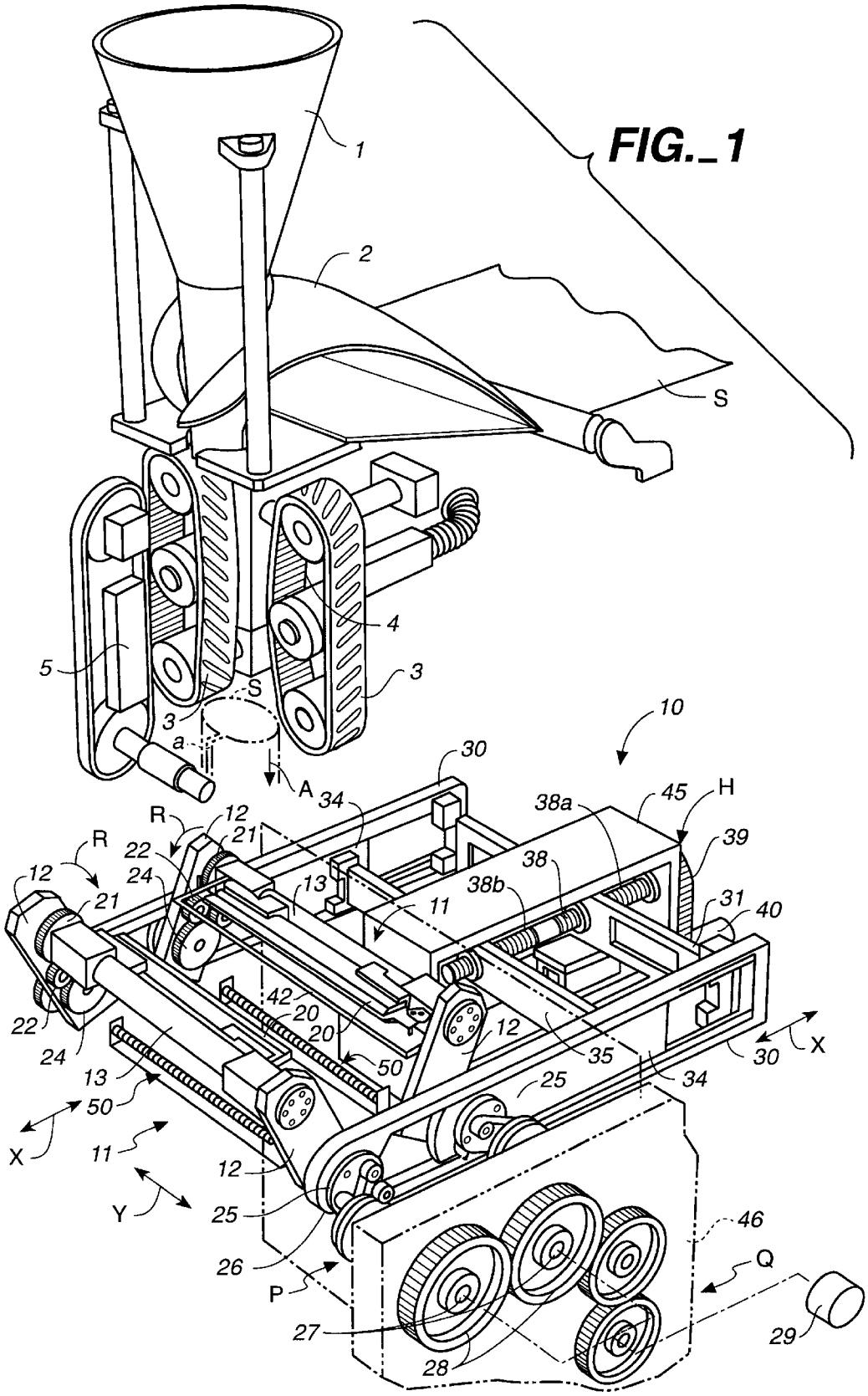
FIG. 1 is a diagonal external view of a pillow-type bag maker-packaging machine incorporating a transverse sealer embodying this invention.

FIG. 1 shows a pillow-type bag maker-packaging machine incorporating a transverse sealer 10 embodying this invention. It is of a kind not requiring the so-called filling cylinder to guide articles into bags being formed. Thus, a former 2, which is attached below an article receiving hopper 1, serves to bend an elongated web of bag-making material ("film") S into a tubular form, while a pair of pull-down belts 3, disposed mutually opposite to each other below the former 2 and each provided with a suction chamber 4, serves to keep the film in the tubular form as longitudinal sealing is effected thereon by a longitudinal sealer 5 over its mutually overlapping side edges (indicated by letter a).

The transverse sealer 10 is disposed below the pull-down belts 3 and is adapted to seal the tubularly formed film S in the direction, indicated by arrows Y, transverse to the vertically downward direction of the film path, comprising a pair of transverse seal jaws (or transverse sealing means) 20 disposed mutually opposite each other with respect to the film path, a pair of rotary members 11 for causing the seal jaws 20 to rotate in synchronism with respect to each other while always oriented in the same direction, and pairs (left-hand side and right-hand side) of mobile outer frames 30 and inner frames 34 for causing the seal jaws 20 to move in approximately D-shaped trajectories in a vertical plane by moving axes of rotation of rotary arms 12 towards or away from each other. The rotary members 11 are adapted to rotate (in directions indicated by arrows R) such that the direction of motion of the seal jaws 20 and the direction of motion of the film S will coincide when the seal jaws 20 are mutually proximal and on linear sections of their generally D-shaped trajectories.

Figure 2:
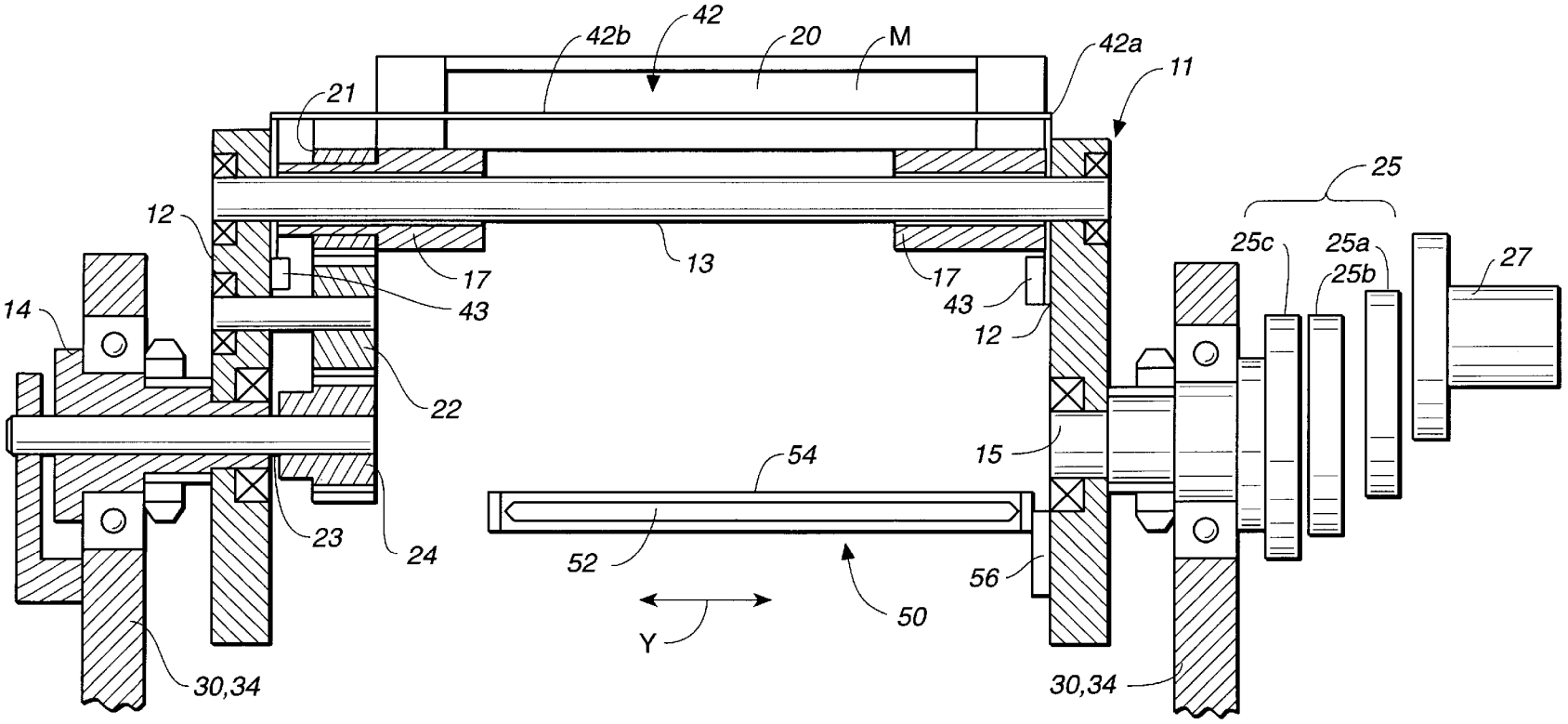
FIG. 2 is a vertically sectional front view of the arm-rotating mechanism of the bag maker-packaging machine of FIG. 1.

As shown more clearly in FIG. 2, each of the pair of rotary members 11 is generally U-shaped with the pair of (left-hand side and right-hand side) arms 12 connected together by a connector bar 13. One of the rotary arms 12 (the one on the left-hand side in FIG. 2) is affixed to a shaft-supporting member 14 which protrudes inwardly from one on the left-hand side of the mobile frames 30, 34. The other of the rotary arms 12 (the one on the right-hand side in FIG. 2) is affixed to a power-input shaft 15 which protrudes inwardly from the other on the right-hand side of the mobile frames 30, 34, collinear with the shaft-supporting member 14, such that each U-shaped rotary member 11 can rotate around an axis of rotation defined by the shaft-supporting member 14 and the power-input shaft 15, by a driving power communicated thereto through the power-input shaft 15.

On each of the pair of rotary members 11, one of the transverse seal jaws 20 for sealing the tubular film S transversely is attached to sleeves 17 which are rotatably supported by the connector bar 13. A sun gear 24, having a specified number of teeth, is fastened to one end of a fixed shaft 23 which penetrates the shaft-supporting member 14. A planet gear 21, having the same number of teeth as the sun gear 24, is unitarily attached to one end of one of the sleeves 17. The planet gear 21 and the sun gear 24 engage with each other through an idler gear 22 in between.

With reference next simultaneously to FIGS. 1 and 2, rotary motion of drive shafts 27, adapted to be driven by an arm-rotating servo motor 29, is communicated to corresponding one of the power-input shafts 15 through a Schmidt coupling mechanism 25 of a known kind with three disks 25*a*, 25*b* and 25*c* mutually connected with links 26, the first disk 25*a* being connected to the drive shaft 27 and the third disk 25*c* connected to the power-input shaft 15, such that the rotation of the drive shaft 27 can be communicated to the corresponding power-input shaft 15 without causing slips in the angle of rotation or torque, independently of the distance between their axes of rotation. The two drive shafts 27, each corresponding to one of the pair of rotary members 11, are coupled to each other through mutually engaging gears 28 such that the pair of rotary members 11 will rotate in mutually opposite directions, as shown by arrows R in FIG. 1.

Those of the components described above which serve to move the seal jaws on specified D-shaped trajectories will be hereinafter referred to as the trajectory-forming means H. The rotary members 11, the trajectory-forming means H and the Schmidt coupling mechanism 25 will be referred to as the power-transmitting means P. The drive shafts 27, the mutually engaging gears 28 therefor and the arm-rotating servo motor 29 are referred to as the driving means Q.

Figure 5:
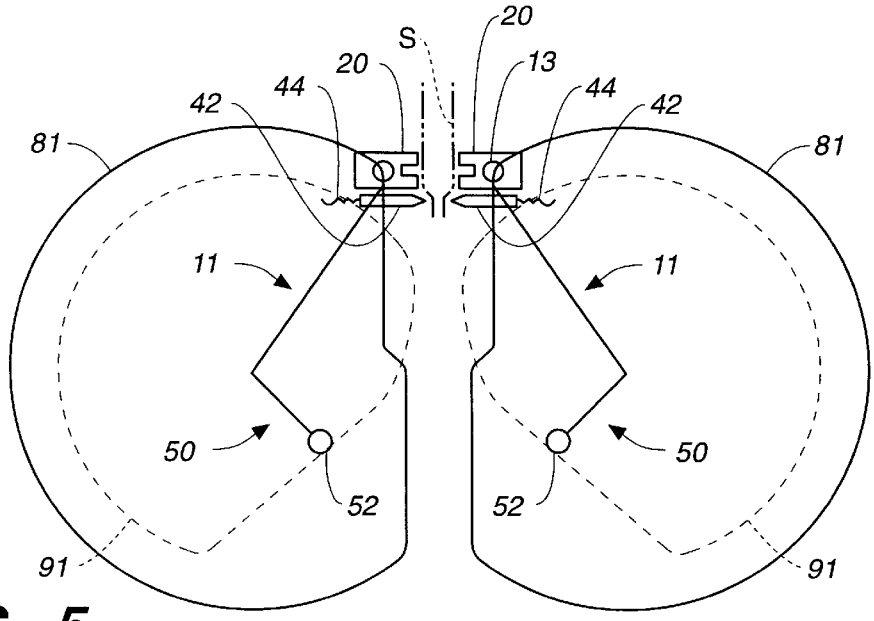
FIG. 5 is a schematic sketch for showing the trajectories of the transverse seal jaws and the cramming devices of the bag maker-packaging machine described above.

As shown in FIG. 2, a generally U-shaped stripping rod 42, having leg parts 42*a* extending perpendicularly from both ends of its transversely extended stripping part 42*b*, is attached to each seal jaw 20 for stripping down articles to be packaged inside a bag being formed immediately before its upper edge is transversely sealed such that they will not be caught where the sealing takes place. The leg parts 42*a* of the stripping rod 42 are inserted into brackets 43 which are attached to inner walls of the rotary arms 12 and are biased by springs 44, as schematically shown in FIG. 5, such that the stripping part 42*b* protrudes towards the film S from the frontal heat-applying sealing surface M of the sealing jaw 20. The trajectory-forming means H is adapted to cause the stripping parts 42*b* of the pair of stripping rods 42 to come together and sandwich the film S therebetween before the mutually opposite sealing surfaces M of the pair of seal jaws 20 come to contact each other and to move in the direction of motion (indicated by letter A in FIG. 1) of the film S, such that the articles which have been dropped inside the bag being formed are stripped downward from the area where the sealing takes place.

Figure 4:
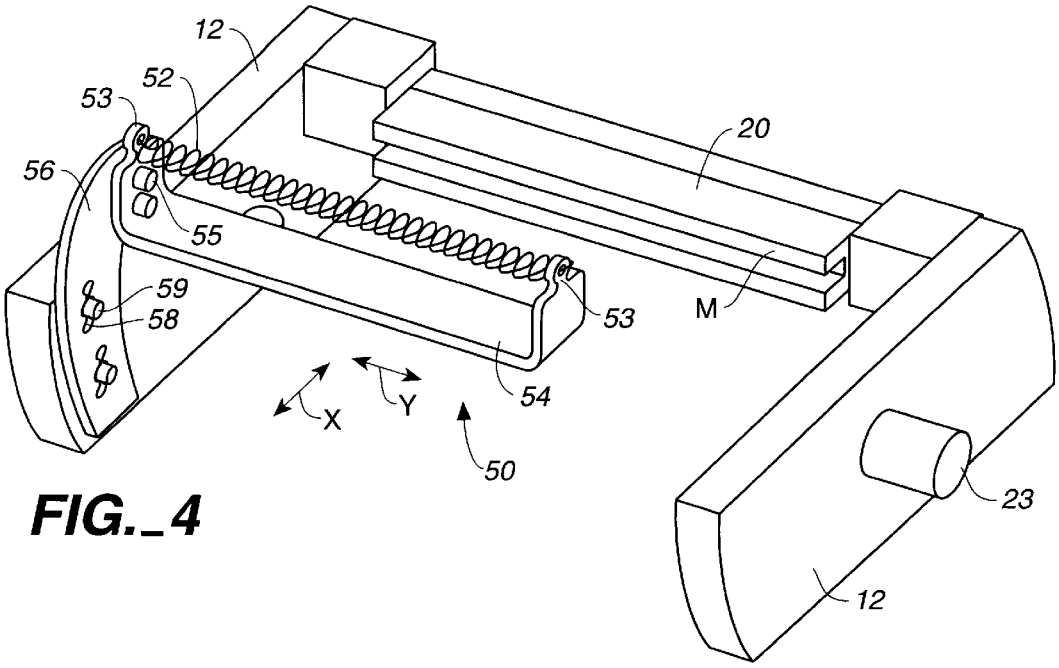
FIG. 4 is a diagonal external view of the cramming device of the bag maker-packaging machine of FIG. 1.

The transverse sealer 10 according to this invention is further provided with a pair of cramming devices 50, each attached to one of the rotary arms 12 as shown in FIG. 4, for pushing the articles downwards so as to "settle" inside the bag-shaped film S by stroking and pressing the film S from outside without purposefully closing it prior to the stripping by the stripping rods 42 on an upper part of the bag being made such that the bag will come to be more tightly packed. Each cramming device 50 comprises a cramming bar 52 made of a coil spring extended in the Y-direction with its ends engaged to protrusions 53 on both ends of a generally U-shaped holder 54. The pair of cramming bars 52 is adapted to push the bag being made both from the front and from the back in the X-directions (or the forward-backward directions), as shown also in FIG. 5, while being elastically deformed. The holder 54 is fastened at one end to a supporting member 56 by screws 55. The supporting member 56 is in turn fastened to one of the rotary arms 12 and is provided with elongated holes 58 for adjusting its position of attachment. The rotary arm 12, to which the supporting member 56 is to be thus attached adjustably, is provided with screw holes (not shown). Tightening means, such as bolts or screws 59, are inserted through the elongated position-adjusting holes 58 into these screw holes to adjustingly fasten the supporting member 56, and hence the cramming bar 52, to the rotary arm 20. In other words, the position of the cramming device 50 with respect to the rotary arm 20 can be appropriately varied to the extent of these elongated position-adjusting holes 58, according to the desired force with which the loaded bag should be pushed for cramming. Although FIG. 4 shows an embodiment wherein the elongated position-adjusting holes 58 are provided to the supporting member 56, it is equally practical to provide the rotary arm 20 with elongated holes and the supporting member 56 with screw holes.

The mobile outer and inner frames 30 and 34 are for supporting the pair of rotary members 11 such that the distance between the axes of rotation of the rotary arms 12 can be varied. The pairs of outer and inner frames 30 and 34 are respectively connected to each other near the back ends (away from the path of the film S) by a connecting plate 31 or 35, respectively, to form generally U-shaped, or three-sided, frame structures. They are assembled together such that the outer frames 30 can slide in the forward-backward directions (shown by arrows X) on a main body frame 46 (shown in FIG. 1) and that the inner frames 34 can each slide inside one of the outer mobile frames 30 also in the forward-backward directions.

Figure 3:
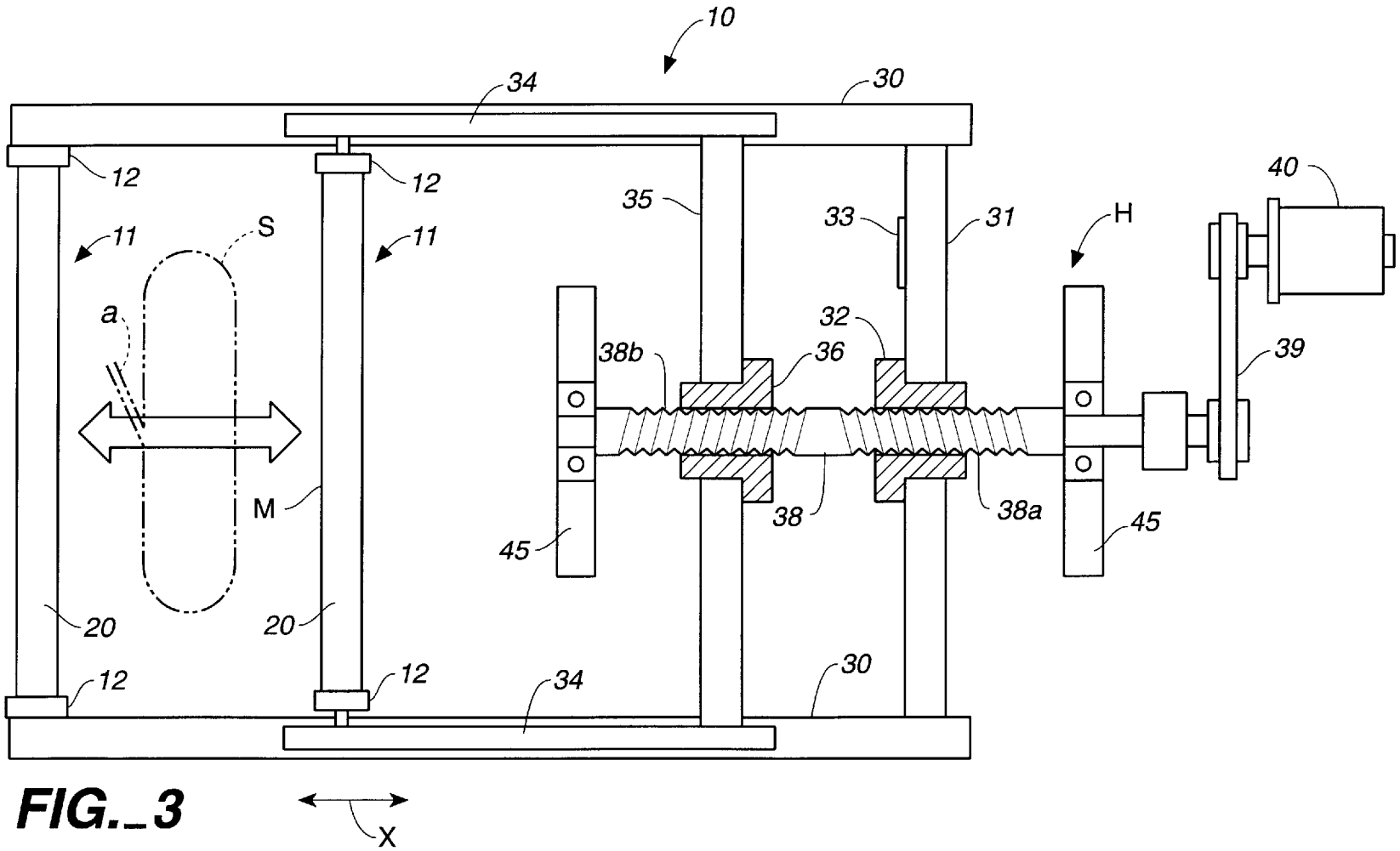
FIG. 3 is a schematic plan view of the arm-moving mechanism of the bag maker-packaging machine of FIG. 1.

As shown both in FIGS. 1 and 3, a turnbuckle 38 is provided for moving the outer and inner frames 30 and 34 in the forward-backward directions in a mutually coordinated manner such that each of the seal jaws 20 can be moved in a desired D-shaped rotary trajectory including a linear section. As shown more clearly in FIG. 3, this turnbuckle 38 is axially supported by a frame structure 45 affixed to the main body frame 46 and has a right-handed screw part 38*a* and a left-handed screw part 38*b*. The right-handed screw part 38*a* engages through a linear bearing 32 to the connecting plate 31 for the outer frames 30, and the left-handed screw part 38*b* engages through another linear bearing 36 to the other connecting plate 35 for the inner frames 34 such that the outer and inner frames 30 and 34 can be moved in mutually opposite directions to cause the pair of rotary members 11 to move towards or away from each other by turning the turnbuckle 38 selectively in one direction or the other. The linear bearings 32 and 36 may be of a known kind having many balls which engage with the screw parts 38*a* and 38*b* so as to add torque to an arm-shifting motor 40, or to turn the turnbuckle 38 when a force is applied to the frames 30 and 34 in the forward-backward direction by the reaction to the sealing pressure. The arm-shifting motor 40 may be an AC servo motor capable of freely switching between torque-control and speed-controlled modes of operation, connected to the turnbuckle 38 through a timing belt 39. In the torque-control mode of operation, the torque of the motor 40 is kept at a specified level independent of its speed but this specified level can be varied suitably. In the speed-controlled mode of operation, its rotational speed can be made constant independent of the torque. As explained more in detail below and also in U.S. Pat. No. 5,347,795 issued Sep. 20, 1994 (which is herein incorporated by reference), the arm-shifting motor 40 is controlled by a control circuit (not shown herein) so as to be able to rotate in either direction in coordination with the arm-rotating servo motor 29 such that the transverse seal jaws 20 will each travel in the specified generally D-shaped trajectory as shown at 81 in FIG. 5.

Next, the movements of some of the components described above will be explained. With reference first to FIG. 2, the pair of rotary members 11 are caused to rotate around the shaft supporting member 14 and the power-input shaft 15 through the Schmidt coupling mechanism 25 (or the axis of rotation of rotary arm 12), and this causes the planet gear 21 to rotate both around the sun gear 24 and around itself, allowing the transverse seal jaws 20 to undergo a rotary motion while remaining oriented constantly in the same horizontal, mutually opposite direction towards each other. In the meantime, the mobile outer and inner frames 30 and 34 engaging separately with the right-handed screw part 38*a* and the left-handed screw part 38*b* of the turnbuckle 38 repeat their reciprocating linear motions away from and towards each other, in accordance with the rotations of the arm-shifting motor 40 in the positive and negative directions in synchronism with the rotation of the rotary members 11 such that the transverse seal jaws 20 supported thereby undergo rotary motions on the specified generally D-shaped trajectories 81 as shown in FIG. 5.

Figure 6A:
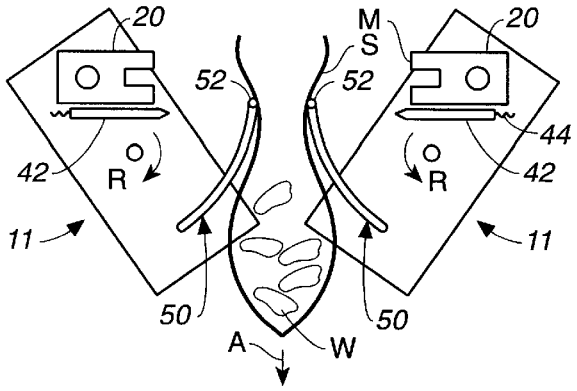
FIGS. 6A, 6B, 6C and 6D are sketches for showing the operations of the cramming device and the stripping rods.
Figure 6B:
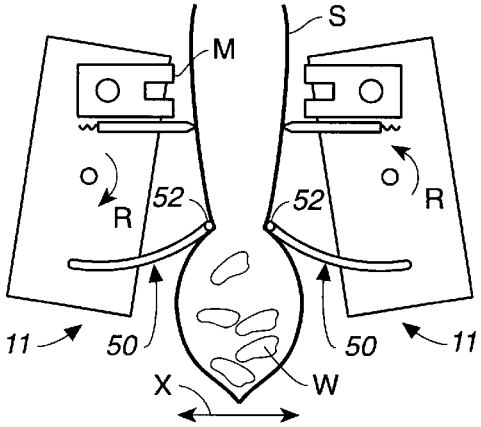

After the film S is bent into a tubular form by the former 2, pulled downward by the pull-down belts 3 and made into the shape of a bag with its bottom transversely sealed, articles W to be packaged therein are dropped from the hopper 1. The rotary members 11 are then brought to the position shown in FIG. 6A, referred to as the start-cramming position at which the pair of transverse seal jaws 20, as well as the pair of stripping rods 42, is farther apart from each other but the pair of cramming bars 52 begins to stroke and push the bag being made in the forward-backward directions from both sides without coming together to purposefully close the bag such that the empty spaces inside the bag gradually come to be filled, as shown in FIG. 6B. This cramming or product-settling operation continues until the rotary members 11 come to the position shown in FIG. 6C, referred to as the end-cramming position, while the cramming bars 52 each move in a truncated D-shaped trajectory (of a different shape from the trajectories shown at 81) shown at 91 in FIG. 5. During this period in the cyclic motion of the rotary members 11, the cramming bars 52 stroke and press the film S from opposite sides without necessarily closing it, although gently while undergoing elastic deformations themselves, to fill the empty spaces among the articles W initially piled loosely inside the bag being formed.

Figure 6C:
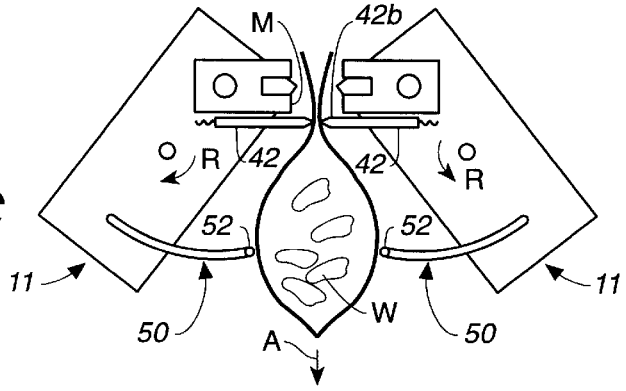
Figure 6D:
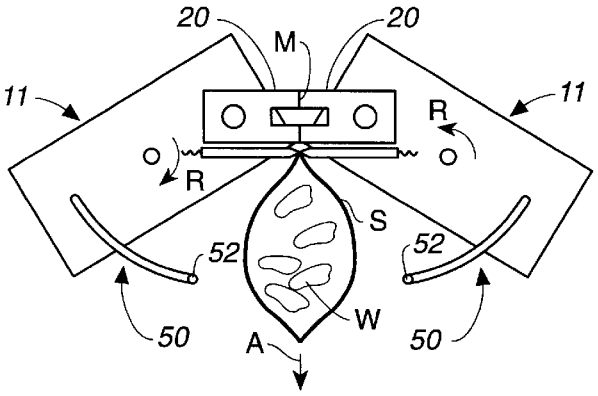

After the rotary members 11 reach the end-cramming position as shown in FIG. 6C, the stripping rods 42, which protrude towards each other from the frontal sealing surfaces M of the pair of seal jaws 20, come into contact with the film S and substantially with each other, sandwiching it between their transversely extended stripping parts 42*b* and beginning the stripping operation, as explained in detail in aforementioned U.S. Pat. No. 5,347,795 issued Sep. 20, 1994, to strip down the articles W inside the bag, thereby preventing pieces of the articles W from remaining at the sealing area over which the film S is to be sealed between the seal jaws 20. After the stripping operation, the seal jaws 20 are brought together, as shown in FIG. 6D, pressing the film S in the forward-backward direction shown by arrows X, while moving vertically downward, as shown by arrow A, with the motion of the film S. This concludes the transverse sealing operation in the cyclic operation of the bag maker-packaging machine.

It is to be noted that the cramming operation by the cramming device 70 is effected prior to the stripping operation which is effected immediately before the transverse sealing. Thus, as schematically shown in FIG. 6 and more clearly in FIG. 2, each stripping rod 42 is disposed much more closely to the sealing surface M of the corresponding seal jaw 20 than the cramming bar 52.

Figure 7:
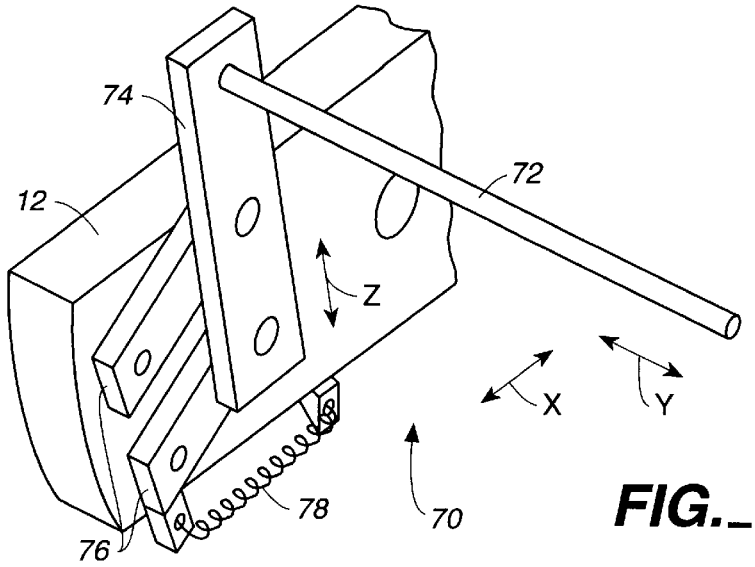
FIG. 7 is a diagonal view of another cramming device embodying this invention.
Figure 8A:
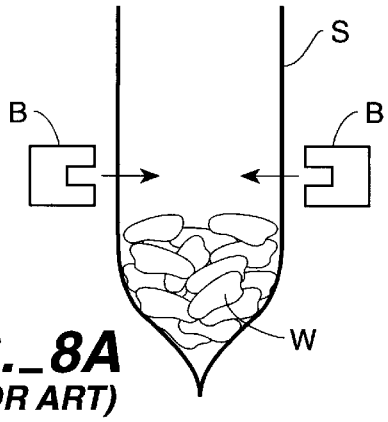
FIG. 8A (PRIOR ART)
FIGS. 8A, 8B and 8C are sketches for showing the transverse sealing and stripping operations according to prior art technology.
Figure 8B:
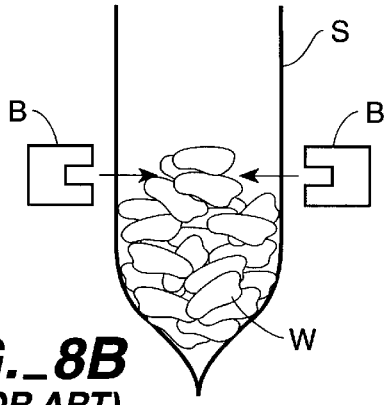
FIG. 8B (PRIOR ART)
Figure 8C:
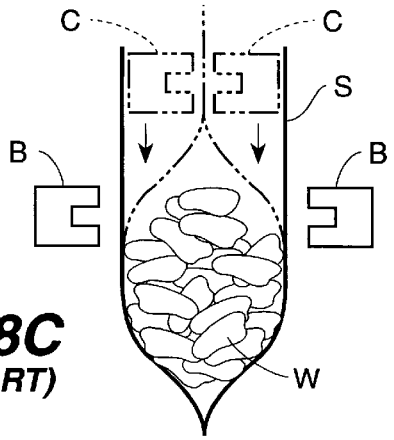
FIG. 8C (PRIOR ART)

FIG. 7 shows another cramming device 70 embodying this invention, which may be used instead of the cramming device 50 described above, having a cramming bar 72 made of a resin or metallic material, which may not be elastically deformable, and extending in the transverse direction (Y-direction). One end of the cramming bar 72 is attached to one of the pair of the rotary arms 12 through a holder 74. The end of the cramming bar 72 is firmly attached to the holder 74, but the holder 74 is attached to the rotary arm 12 so as to be movable in a selected direction indicated by arrow Z in FIG. 7, perpendicular to the Y-direction. For this purpose, a pair of elongated holder supporting members 76 is provided, each rotatably attached to the rotary arm 12 and to the holder 74, and connected so as to remain parallel to each other. The direction indicated by arrow Z is determined by the relative positions of the axes of rotation of the supporting members 76 with respect to the rotary arm 12. One of the supporting members 76 is provided with a biasing spring 78 such that the cramming bar 72 normally protrudes towards the film S when the rotary members 11 are at the start-cramming position. With cramming means 70 thus structured, the cramming bar 72 itself does not elastically flex but, since its holder 74 can be displaced easily by elastically compressing the spring 78, a cramming operation can be effected equally satisfactorily, without breaking the articles W being packed or damaging the film S.

Although the invention has been described above with reference to only a limited number of embodiments, these described embodiments are not intended to limit the scope of the invention. Many modifications and variations are possible within the scope of the invention. For example, although the use of a pair of mobile inner and outer frames has been disclosed as an example of means for moving the axes of rotation of the rotary arms, many other systems can be substituted therefor, such as a system using cams or air cylinders. FIGS. 5 and 6 are intended to be schematic sketches merely for showing the principles of cramming and stripping operations. The trajectories 91 of the cramming bars 52 can be modified, depending on the nature of the articles W being packaged, by appropriately adjusting the attachment of the supporting members 56 or 76. In summary, the disclosure is intended to be interpreted broadly. For example, the cramming device according to this invention, unlike means for stripping, is primarily intended to cause the articles to settle. For this reason, it is not intended to close the bag while stroking and pushing the film from outside but the invention need not affirmatively prevent the bag from becoming closed, say, instantaneously during the course of its cramming operation. All modifications and variations that may be apparent to a person skilled in the art are all intended to be within the scope of the invention.

What is claimed is:

1. A transverse sealer for a bag maker-packaging machine, said bag maker-packaging machine having a former for bending an elongated web of bag-making material into a tubular form, dropping articles to be packaged into said tubularly formed bag-making material while transporting said bag-making material along a specified path, and to thereafter seal said bag-making material transversely to said path, said transverse sealer comprising:

a pair of transverse sealing means, disposed on downstream side of said former relative to said path and on opposite sides of said path, for thermally sealing said bag-making material in a transverse direction relative to said path;

a power transmitting means for transmitting power to cause said pair of transverse sealing means to undergo revolving rotary motions in mutually opposite directions, said power transmitting means including a trajectory forming means for causing each of said transverse sealing means to move completely around and over a specified closed-loop trajectory; and cramming devices connected to said power transmitting means to undergo a different revolving rotary motion completely around and over another closed-loop trajectory of a different shape from said specified closed-loop trajectory in coordination with said rotary motion of said transverse sealing means for stroking and pressing said bag-making material from both sides thereof without substantially closing said tubularly formed bag-making material to thereby reduce empty spaces among said articles inside said tubularly formed bag-making material.

2. The transverse sealer of claim 1 wherein said power transmitting means further includes rotary members connected to said trajectory forming means for rotating said transverse sealing means, said cramming devices being supported by said rotary members.

3. The transverse sealer of claim 2 wherein said cramming devices include adjustably attaching means for adjustably attaching said cramming devices each to associated one of said rotary members.

4. The transverse sealer of claim 3 wherein said adjustably attaching means include elongated holes formed through either selected from said cramming device and said rotary members and tightening means for being passed through said elongated holes and thereby fastening said cramming devices to said rotary members.

5. The transverse sealer of claim 1 wherein said cramming devices comprise elastically deformable bars adapted to push said bag-making material on said path from both sides while being elastically deformed in said forward-backward directions.

6. The transverse sealer of claim 1 wherein said transverse sealing means have sealing surfaces, which are in face-to-face relationship with each other, and a pair of stripping rods normally protruding towards each other from said sealing surfaces, said trajectory forming means functioning so as to cause said stripping rods to sandwich and thereby substantially close said bag-making material therebetween immediately before said sealing surfaces start transversely sealing said bag-making material and to strip said bag-making material by moving said pair of stripping rods along said path while keeping said bag-making material substantially closed therebetween.

7. The transverse sealer of claim 6 wherein said stripping rods strip said bag-making material after said cramming device stroke and press said bag-making material.

8. The transverse sealer of claim 5 wherein said transverse sealing means have sealing surfaces, which are in face-to-face relationship with each other, and a pair of stripping rods normally protruding towards each other said sealing surfaces, said trajectory forming means functioning so as to cause said stripping rods to sandwich and thereby substantially close said bag-making material therebetween immediately before said sealing surfaces start transversely sealing said bag-making material and to strip said bag-making material by moving said pair of stripping rods along said path while keeping said bag-making material substantially closed therebetween, said sealing surfaces being disposed substantially closer to said stripping rods than to said deformable bars of said cramming devices.

9. The transverse sealer of claim 1 wherein said cramming devices each move completely around and over a truncated D-shaped trajectory.

10. The transverse sealer of claim 2 wherein both said rotary members and said cramming devices are adapted to make complete rotations around axes of rotations which are moved towards and away from each other.

11. A bag maker-packaging machine comprising:

a web-transporting means for causing an elongated web of bag-making material to be transported along a specified path;

a former disposed in said path for bending said bag-making material into a tubular form;

a longitudinal sealer for longitudinally sealing mutually overlapping side edge parts of said tubularly formed bag-making material;

means for dropping articles to be packaged into said tubularly formed bag-making material; and a transverse sealer for sealing said tubularly formed bag-making material transversely to the direction of said path while said bag-making material is transported by said web-transporting means along said specified path, said transverse sealer comprising:

a pair of transverse sealing means, disposed on downstream side of said former relative to said path and on opposite sides of said path, for thermally sealing said bag-making material in a transverse direction relative to said path;

a power transmitting means for transmitting power to cause said pair of transverse sealing means to undergo revolving rotary motions in mutually opposite directions, said power transmitting means including a trajectory forming means for causing each of said transverse sealing means to move completely around and over a specified closed-loop trajectory; and cramming devices connected to said power transmitting means to undergo a different revolving rotary motion completely around and over another closed-loop trajectory of a different shape from said specified closed-loop trajectory in coordination with said rotary motion of said transverse sealing means for stroking and pressing said bag-making material from both sides thereof without substantially closing said tubularly formed bag-making material to thereby reduce empty spaces among said articles inside said tubularly formed bag-making material.

12. The bag maker-packaging machine of claim 11 wherein said power transmitting means further includes rotary members connected to said trajectory forming means for rotating said transverse sealing means, said cramming devices being supported by said rotary members.

13. The bag maker-packaging machine of claim 12 wherein said cramming devices include adjustably attaching means for adjustably attaching said cramming devices each to associated one of said rotary members.

14. The bag maker-packaging machine of claim 13 wherein said adjustably attaching means include elongated holes formed through either selected from said cramming device and said rotary members and tightening means for being passed through said elongated holes and thereby fastening said cramming devices to said rotary members.

15. The bag maker-packaging machine of claim 11 wherein said cramming devices comprise elastically deformable bars adapted to push said bag-making material on said path from both sides while being elastically deformed in said forward-backward directions.

16. The bag maker-packaging machine of claim 11 wherein said transverse sealing means have sealing surfaces, which are in face-to-face relationship with each other, and a pair of stripping rods normally protruding towards each other from said sealing surfaces, said trajectory forming means functioning so as to cause said stripping rods to sandwich and thereby substantially close said bag-making material therebetween immediately before said sealing surfaces start transversely sealing said bag-making material and to strip said bag-making material by moving said pair of stripping rods along said path while keeping said bag-making material substantially closed therebetween.

17. The bag maker-packaging machine of claim 16 wherein said stripping rods strip said bag-making material after said cramming device stroke and press said bag-making material.

18. The bag maker-packaging machine of claim 15 wherein said transverse sealing means have sealing surfaces, which are in face-to-face relationship with each other, and a pair of stripping rods normally protruding towards each other said sealing surfaces, said trajectory forming means functioning so as to cause said stripping rods to sandwich and thereby substantially close said bag-making material therebetween immediately before said sealing surfaces start transversely sealing said bag-making material and to strip said bag-making material by moving said pair of stripping rods along said path while keeping said bag-making material substantially closed therebetween, said sealing surfaces being disposed substantially closer to said stripping rods than to said deformable bars of said cramming devices.

19. The bag maker-packaging machine of claim 11 wherein said cramming devices each move completely around and over a truncated D-shaped trajectory.

20. The bag maker-packaging machine of claim 12 wherein both said rotary members and said cramming devices are adapted to make complete rotations around axes of rotations which are moved towards and away from each other.

* * * * *